US005101992A

United States Patent [19]

Serre

[11] Patent Number: 5,101,992

[45] Date of Patent: Apr. 7, 1992

[54] ADJUSTABLE AIR INFLOW FOR FEEDING-BOTTLE DEVICE

[75] Inventor: Jean-Louis Serre, Voiron, France

[73] Assignee: Johnson & Johnson Consumer Products, Inc., Skillman, N.J.

[21] Appl. No.: 641,227

[22] Filed: Jan. 14, 1991

[30] Foreign Application Priority Data

Jan. 12, 1990 [FR] France ..... 90 00342

[51] Int. Cl.[5] ..... A61J 9/04; A61J 11/04

[52] U.S. Cl. ..... 215/11.5; 215/11.1

[58] Field of Search ..... 215/11.1-11.6

[56] References Cited

U.S. PATENT DOCUMENTS

| | | | |
|---|---|---|---|
| 2,426,927 | 9/1947 | Ganson | 215/11.5 |
| 2,520,157 | 8/1950 | Little | 215/11.5 |
| 2,623,524 | 12/1952 | Clemens | 215/11.5 X |
| 2,720,328 | 10/1955 | Clemens | 215/11.5 |
| 2,822,102 | 2/1958 | Holland | 215/11.1 |
| 2,889,064 | 6/1959 | Kurkjian | 215/11.1 |
| 2,942,746 | 6/1960 | Porthouse et al. | 215/11.1 |
| 2,979,078 | 4/1961 | Witz | 215/11.4 X |
| 3,292,809 | 12/1966 | Shomock et al. | 215/11.5 |
| 3,589,545 | 6/1971 | Carpenter, Jr. et al. | 215/349 X |
| 3,770,154 | 11/1973 | Johnson | 215/11.5 |

FOREIGN PATENT DOCUMENTS

| | | | |
|---|---|---|---|
| 540196 | 4/1957 | Canada | 215/11.5 |
| 9459 | 4/1980 | European Pat. Off. | 215/11.1 |
| 1766931 | 9/1971 | Fed. Rep. of Germany . | |
| 998099 | 1/1952 | France | 215/11.5 |

*Primary Examiner*—Sue A. Weaver

[57] ABSTRACT

The present invention relates to a feeding-bottle device with an adjustable air inflow, comprising a feeding bottle, a teat and a ring clamping the teat onto the feeding bottle. The teat has an annular collar intended to be retained between the rim of the feeding bottle and a flange of a clamping ring screwed onto the feeding bottle. The collar bears on the rim by means of ribs betwen them delimiting air-inlet passages. Opposite a localized annular zone of the rim, each rib has an interruption arranged in correspondence with a moulding for the bearing of the flange on the collar. Thus, by screwing the clamping ring into the feeding bottle to a greater or lesser extent, the effective cross-section of the air-inlet passages can be adjusted, deforming the collar as a result of a lever effect exerted between the moulding and the ribs, especially until the air inlet passages are closed. Leaks of the liquid contained in the feeding bottle when the child stops sucking can thus be prevented.

9 Claims, 8 Drawing Sheets 1
2
3
4
6
7
8
10
11
12
14
15
16
17
18
18'
19
20
21
22
23
24
29
30
31
32
35
36
37
38
39
40
41
42
43
44
45
46
47
48
49
50
51
135

11
238
239
245
204
208
243
230
242
249
247
229
205
206
251
50
201
22
21
244
241
246
207
32
202

ADJUSTABLE AIR INFLOW FOR FEEDING-BOTTLE DEVICE

BACKGROUND OF THE INVENTION

The present invention relates to a feeding-bottle device with an adjustable air inflow. More particularly, the feeding-bottle device comprises a feeding bottle having an annular rim face, a clamping ring and a teat having an annular collar. A plurality of substantially radially extending ribs, disposed on one of the rim face of the bottle and the lower face of the teat collar, form delimiting air-inlet passages between the teat and the rim of the feeding bottle.

The function of these passages is, in proportion to the consumption of a liquid contained in the feeding bottle, to allow an inflow of air compensating this consumption and thus making it possible to keep the interior of the feeding bottle at atmospheric pressure so as to make sucking easier.

Teats are currently marketed under the brand name of "Dodie" in an embodiment according to which each rib is formed on the lower face of the collar and overlaps the rim of the feeding bottle continuously, that is to say from an edge of this rim facing towards the inside of the feeding bottle to an edge of this rim facing the outside of the feeding bottle.

In this known embodiment, the air inflow is effective when the child user absorbs the liquid contained in the feeding bottle very quickly, but as soon as the child sucks slowly or stops sucking the liquid leaks out via the air-inlet passages, this having an unpleasant effect on the surroundings.

Admittedly, the leaks of liquid can be limited to some extent by screwing the clamping ring vigorously onto the feeding bottle, so as to reduce the effective cross-section of the air-inlet passages by compressing the ribs onto the rim, it is nevertheless impossible in this way to seal off the air-inlet passages completely, that is to say eliminate all the leaks, inasmuch as the ribs preserve a relief in relation to the second face of the collar, even in their state of maximum compression; furthermore, this operation can result in a rapid destruction of the ribs if it is repeated, and it can therefore become impossible to restore an air-inlet passage having a sufficient effective cross-section for when the baby sucks normally.

A completely sealing closure of the air-inlet passages is also impossible when, according to another known embodiment, the ribs are formed on the annular rim face of the feeding bottle, and in this case repeated vigorous screwing of the clamping ring onto the feeding bottle to reduce as far as possible the effective cross-section of the air-inlet passages can result in rapid damage to the second face of the collar of the teat.

SUMMARY OF THE INVENTION

The feeding-bottle device of the present invention comprises:

a feeding bottle having an annular rim face;

a clamping ring screwed on the feeding bottle and comprising an annular flange possessing towards the annular rim face, on the one hand, an annular moulding located opposite a localized annular zone of the annular rim face and, on the other hand, an annular groove formed around the moulding in the immediate vicinity of the latter; and a teat having a flat sealing elastically flexible and elastically compressible annular collar retained between the annular rim face and the flange, the collar possessing, on the one hand, a first flat annular face located opposite the flange and coming to bear on the moulding of the latter and, on the other hand, a second flat annular face located opposite the annular rim face, in which one of the two faces consisting respectively of the second face of the collar and of the annular rim face has a plurality of substantially radial ribs coming to bear on the other of the said two faces, at the same time between them delimiting air-inlet passages with one of the said two faces and the other.

The object of the present invention is to overcome the aforementioned disadvantages, and to achieve this the present invention provides an improvement of the feeding-bottle device, this improvement being characterized in that each of the ribs has an interruption in a zone located opposite the said localized annular zone of the annular rim face, in such a way that it is possible, by screwing the clamping ring onto the feeding bottle to a greater or lesser extent, to adjust the effective cross-section of the air-inlet passages, deforming the collar elastically as a result of a lever effect exerted between the bearing point of its first face on the moulding of the flange and the bearing point of the ribs on the said other of the said two faces.

It thus becomes possible to adjust the effective cross-section of the air passages, including the complete closure of these, by laying the second face of the collar flat onto the rim of the feeding bottle, not only between the ribs, but also at the interruptions of these, without thereby exerting on the collar a clamping liable to cause the destruction of its ribs or of its second face respectively, depending on whether the ribs are formed on this collar or on the feeding bottle; thus, the reduction of the effective cross-section of the air-inlet passages can be carried out as desired, by an easy gesture of screwing the clamping ring onto the feeding bottle, if appropriate until the air-inlet passages are closed completely, in order to prevent any leakage of liquid if the child stops sucking, and the reopening of the air-inlet passages, especially up to their maximum effective cross-section corresponding to the absence of any deformation of the collar, remains possible by another easy gesture of unscrewing the clamping ring, even after a complete closure of the air-inlet passages and even if an alternation of operations of more or less complete closure and then more or less complete reopening of these is repeated frequently.

When the teat is being fitted onto the feeding bottle by screwing the clamping ring onto the latter, the occurrence of bearing of the collar on the flange and on the rim is easily detected by the feeling of the appearance of slight resistance to the screwing, this corresponding to the formation of air-inlet passages affording a maximum effective cross-section; a continuation of screwing counter to this resistance implies the progressive reduction of the effective cross-section of the air passages; the feeling of definite opposition to the continuation of screwing signifies the complete closure of the air passages; when the clamping ring is subsequently progressively unscrewed in order to reopen these, once again there is the feeling of slight resistance to unscrewing, until the maximum effective cross-section is available, under conditions whereby the bearing of the collar on the flange and on the rim is maintained, this being detected by the feeling of a disappearance of this resistance.

On the one hand, because of the pitches conventionally used for screwing the clamping rings onto the feeding bottles, and on the other hand because of the small projection which the ribs form on the second face of the collar, or on the annular rim face of the feeding bottle, the change from one to the other of the limiting positions of the clamping ring in relation to the feeding bottle, corresponding respectively to the maximum effective cross-section of the air-inlet passages and to the complete closure of these, takes place within a fraction of a relative revolution in the screwing or unscrewing direction, for example within approximately one third of a revolution; to make it easier to mark these limiting positions and, more particularly, intermediate positions of partial closure of the air-inlet passages, according to a preferred embodiment of the present invention it is advantageously provided that the clamping ring and the feeding bottle carry in a mutually complementary manner means for marking their state of mutual screwing, for example in the form of at least one stud or at least one spot in relief or recessed on the clamping ring and of at least one stud or at least one spot in relief or recessed on the feeding bottle, making it possible to mark their relative angular position; it thus becomes easy to ascertain the relative position of these marking means when, at the moment when the teat is fitted onto the feeding bottle, the occurrence of bearing of the collar on the flange and on the rim is detected by a feeling of the appearance of the abovementioned slight resistance, and subsequently to know with sufficient accuracy the degree of reduction of the effective cross-section of the air-inlet passages for each degree of subsequent screwing of the clamping ring onto the feeding bottle by reading the corresponding variation in this relative position.

The present invention therefore affords a useful addition to the various arrangements provided hitherto for making it possible to adjust the liquid outflow rate according to the child's needs, as a result of the rotation of the teat on itself, by means of an appropriate shape of a slit provided for this outflow, French Patent Application No. 88 02290 of 25th Feb. 1988 giving a non-limiting example of such a shape.

The present invention can, of course, have different embodiments, especially as regards the shaping of the ribs; thus, there can be provision that a rib be located on only one side of the respective interruption, in order to come to bear on the said other of the said two faces only on one side of this interruption; preferably, however, there is provision that a rib comprise two portions located respectively on either side of the respective interruption, in order to come to bear on the said other of the said two faces on either side of this interruption, thereby avoiding any risk of inopportune reduction of the effective cross-section of the air-inlet passages under the effect of a vacuum generated inside the feeding bottle as a result of vigorous suction by the child; likewise, the ribs can be distributed in various ways over the second face of the collar, or on the annular rim face of the feeding bottle, and as a non-limiting example it is possible, for example, to select the arrangement known per se, according to which the second face of the collar has three groups of at least one of the said ribs, especially of three ribs, these three groups being offset angularly at 120° relative to one another, on the understanding that a similar arrangement can be adopted when the ribs are provided on the annular rim face of the feeding bottle.

In so far as the implementation of the present invention results, in comparison with the prior art, in the appearance of discontinuities in the conventionally continuous ribs of the second annular face of the teat or of the annular rim face of the feeding bottle, the present invention consists not only of the feeding-bottle device as a whole but also of a teat intended to form part of such an assembly and having the said ribs, with the said interruptions, on the second face of the collar, and of a feeding bottle likewise intended to form part of such a device and having the said ribs, with the said interruptions, on the annular rim face.

It will be seen that, when it interacts with a teat and a feeding bottle of a feeding-bottle device produced according to the present invention, the moulding, usually provided on the flange of the clamping ring for the sole purpose of ensuring an effect of a gripping of the collar of the teat as a result of the pinching of this collar on the rim of the feeding bottle by means of the ribs, performs a different function which is to shape the collar in order to obtain, as desired, the adjustment of the effective cross-section of the air-inlet passages; although, in this case, this moulding retains an effect of a gripping of the collar, it is nevertheless preferable, according to a preferred embodiment of the present invention, to reinforce the retention of this collar between the flange of the clamping ring and the rim of the feeding bottle by ensuring that the first face of the collar possesses, round a localized annular zone corresponding to the interruptions of the ribs, that is to say intended for the bearing of the first face of the collar on the moulding of the flange of the clamping ring, an annular edge engaged in the groove of the flange when the collar is retained between the rim and the flange; then, preferably, the engagement of the edge of the first face of the collar in the groove of the flange of the clamping ring is reinforced, ensuring that, if the ribs are located on only one side of the respective interruption, these ribs are arranged in correspondence with the edge of the first face of the collar, and that, if each rib comprises two portions located respectively on either side of the respective interruption, some of these portions are arranged in correspondence with the edge of the first face of the collar.

It will be seen that by thereby ensuring an effective retention of the collar of the teat the interaction between the annular edge of the first face of this collar and the groove of the flange of the clamping ring ensures an exact positioning of the interruptions of the ribs in relation to the rim of the feeding bottle, when the ribs are provided on the second face of the collar of the teat, that is to say ensures a bearing of the ribs on this rim under conditions suitable for allowing the desired deliberate deformation of the collar.

By virtue of this special manner of interaction of the teat with the clamping ring on the one hand and with the rim of the feeding bottle on the other hand, within the framework of a feeding-bottle device according to the invention, the present invention resides not only in this device and in the teat and in the feeding bottle having respectively the ribs with the interruptions of these, but also in the combination of such a teat or of such a feeding bottle with the clamping ring having the said moulding and the said groove.

Other characteristics and advantages of a device according to the invention will emerge from the following description relating to two non-limiting exemplary embodiments of such a device and from the accompanying drawings which form an integral part of this description.

DETAILED DESCRIPTION OF THE PREFERRED EMBODIMENTS

Reference will be first be made to FIGS. 1 to 4, which illustrate a teat according to the invention 1.

Figure 3:
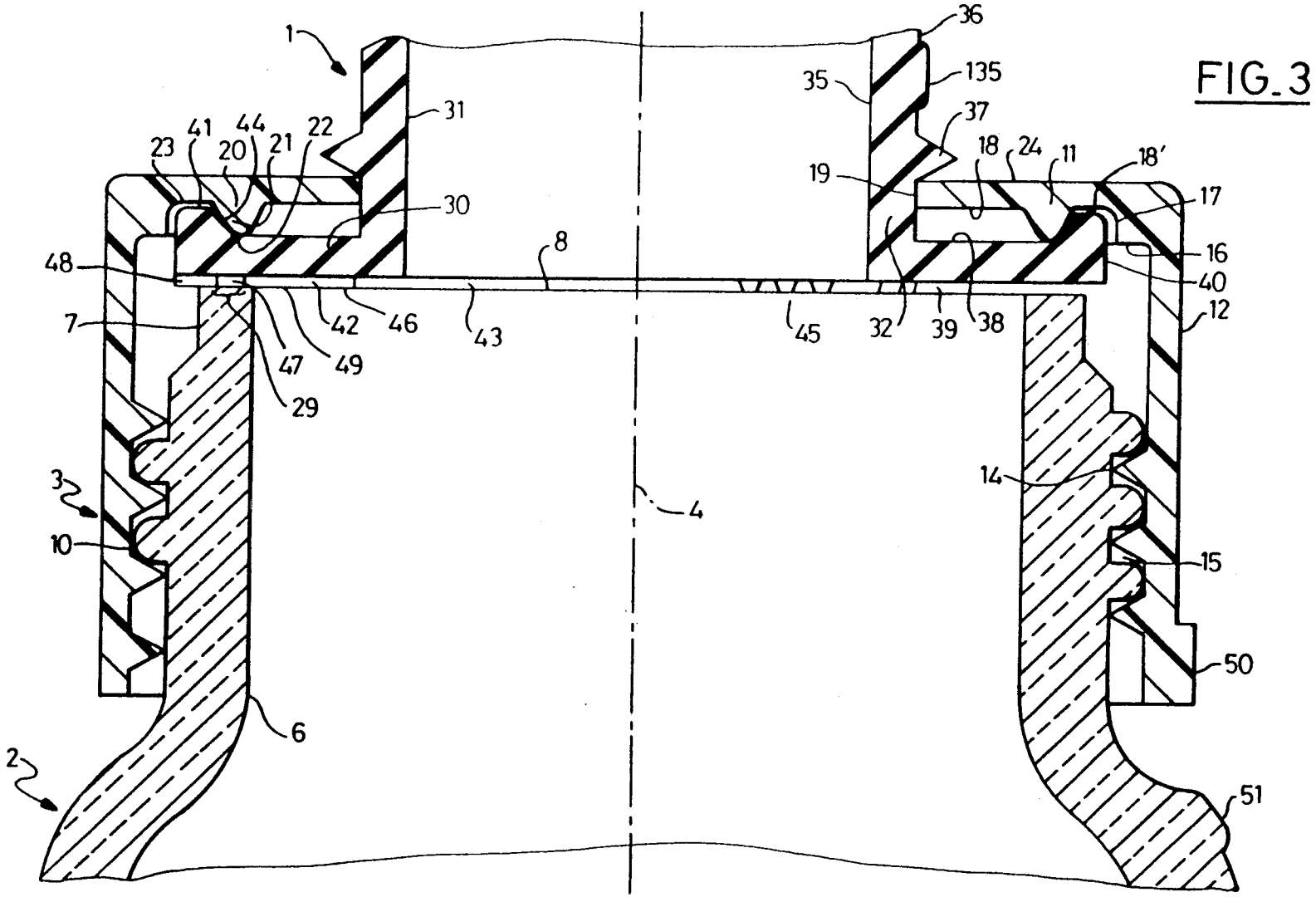
FIG. 3 shows an enlarged view of a detail of FIG. 1.
Figure 4:
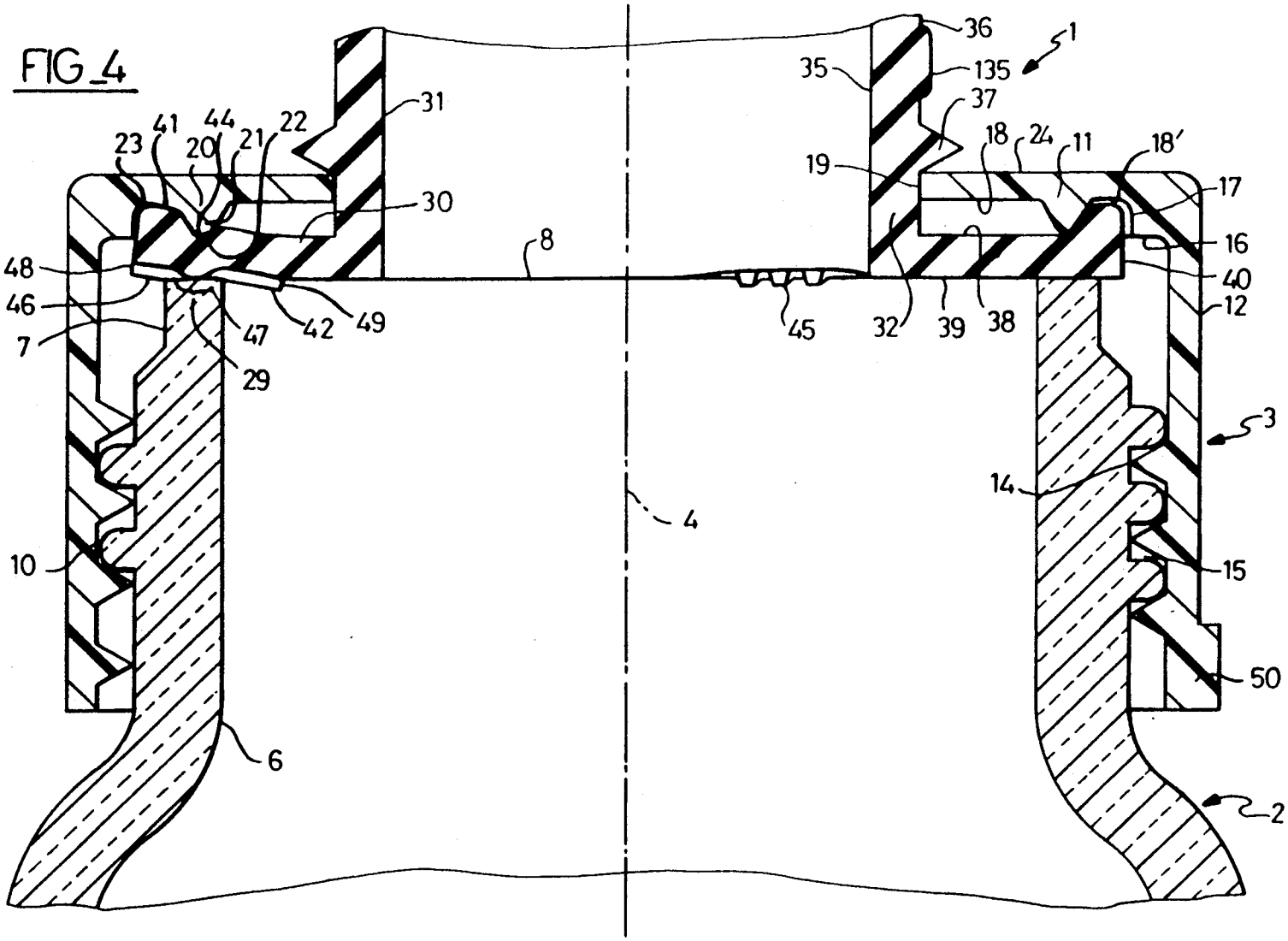
FIG. 4 shows a similar view of the same detail, but in which the clamping of the collar of the teat on the rim of the feeding bottle by means of the clamping ring is such that the air-inlet passages are completely closed.

For the sake of convenience, the teat according to the invention 1 will be described in the state assembled together with a feeding bottle 2 and a clamping ring 3, as emerges from FIGS. 1, 3 and 4, but, except when mentioned explicitly in relation to FIG. 4 showing it in the elastically deformed state, it will be described, as it emerges from FIGS. 1 to 3, in the state of rest, that is to say without deformation.

Reference will first be made to these FIGS. 1 to 3, from which it emerges that the teat 1 has a general rotational symmetry about an axis 4, in relation to which the feeding bottle 2, at least in a neck zone 5, and the clamping ring 3 likewise have a general rotational symmetry.

More specifically, the neck zone 5 of the feeding bottle 2 is delimited towards the axis 4 by an inner peripheral face 6 cylindrically rotational about this axis and with a radius $R_1$, whilst it is delimited in the direction going away from this axis by an outer peripheral face 7 likewise cylindrically rotational about this axis and with a radius $R_2$ larger than $R_1$, and these two inner and outer peripheral faces 6 and 7 respectively are connected to one another by means of a smooth plane annular face 8 perpendicular relative to the axis 4 and forming the rim of the feeding bottle 2; at a particular non-designated distance from the rim 8 in parallel with the axis 4, the outer peripheral face 7 of the neck zone 5 widens progressively into an outer peripheral face 9 likewise cylindrically rotational about the axis 4 and with a radius $R_3$ larger than $R_2$, this outer peripheral face 9 possessing in relief, however, a helical thread 10 of a maximum radius $R_4$ larger than $R_3$ and of a substantially semicircular cross-section when this thread 10 is seen in a section taken in a plane including the axis 4.

In a known way, the feeding bottle 2 is produced from a rigid material, for example glass or a suitable synthetic material.

The ring 3 is likewise produced from a rigid material, for example a synthetic material, and, to ensure the fastening of the teat 1 on the neck zone 5 of the feeding bottle 2, possesses a flat annular flange 11, perpendicular relative to the axis 4 and located opposite the rim 8, and a skirt 12 bordering the flange 11 peripherally and intended for ensuring the screwing of the ring 3 onto the helical thread 10 of the neck zone 5 of the feeding bottle 2.

For this purpose, the skirt 12 is delimited towards the axis 4 by an inner peripheral face 13 cylindrically rotational about this axis and with a radius substantially equal to $R_4$, and this inner peripheral face 13 possesses in relief, that is to say projecting towards the axis 4, a helical thread 14 of the same pitch as the helical thread 10 and of a minimum radius substantially equal to $R_3$, but with a cross-section different from that of the helical thread 10, for example triangular when this thread 14 is seen in a section taken in a plane including the axis 4; thus, the mutual screwing of the two helical threads 10 and 14 leaves between them a helical air-passage play 15 between the skirt 12 of the ring 3 and the neck zone 5 of the feeding bottle 2.

In the region of the flange 11, the inner peripheral face 13 of the skirt 12 is connected to a plane annular face 16 of the flange 11, the said face 16 being perpendicular relative to the axis 4 and facing towards the rim 8; the inner peripheral face 13 of the skirt 12 delimits this face 16 in the direction going away from the axis 4, whilst towards the latter this face 16 is connected to an inner peripheral face 17 of the flange 11, the said face 17 facing towards the axis 4 and having a general form cylindrically rotational about the latter and with a radius substantially equal to the radius $R_3$; this face 17 connects the face 16 to another plane annular face 18 of the flange 11; this face 18, perpendicular relative to the axis 4, like the face 16, but set back relative to this, likewise faces towards the rim 8; it continues towards the axis 4 until it is connected to an inner peripheral face 19 cylindrically rotational about this axis 4 and facing towards the latter, with a radius $R_5$ smaller than the radius $R_1$, with the result that this face 18 has an annular zone 20 rotational about the axis 4 and directly opposite the rim 8; in this annular zone 20, the face 18 has a continuous annular moulding 21 rotational about the axis 4 and projecting towards the rim 8, more specifically directly opposite an annular zone 29 of the latter, this zone 29 having a form rotational about the axis 4 and being located in an intermediate position between the inner and outer peripheral faces 6 and 7 of the neck zone 5 of the feeding bottle 2, at the same time being spaced from both of these peripheral faces 5 and 7; for this purpose, the moulding 21 has a cross-section which is, for example, hyperbolic when seen in a section taken in a plane including the axis 4, and its zone 22 furthest away from the face 18 in parallel with the axis 4 has the form of a circle centered on the axis 4 and, with reference to the latter, with a radius $R_6$ intermediate between the radii $R_1$ and $R_2$; it will be seen that this continuous circular zone 22 rotational about the axis 4 is plane; in the example illustrated, it is coplanar with the face 16 of the flange 11; between the moulding 21 and the face 17 of the flange 11 there is a zone 18' of the face 18, the said zone 18' delimiting with the face 17 and with the moulding 20, in the flange 11, a continuous annular groove 23 rotational about the axis 4 and facing towards the rim 8.

Moreover, the ring 3 can be of any form whatever, and for example the face 19 of the flange 11 is connected, opposite the face 18 of the latter, to a plane annular face 24 perpendicular relative to the axis 4 and facing away from the face 18, the said face 24 being delimited towards the axis 4 by its connection to the face 19 and in the direction going away from the axis 4 by its connection to a face 25 of the skirt 12; this face 25 is cylindrically rotational about the axis 4 and faces in the direction going away from the latter, with a radius, not designated, larger than $R_4$, so as to extend along the inner face 13, to which it is connected, opposite its connection to the face 24 and opposite the connection of the face 13 to the face 16, by means of an end face 26 of the skirt 12, the said end face 26 being annular, plane and perpendicular relative to the axis 4.

The arrangements just described are known per se, except that, sometimes, the moulding 21 of the flange 11 of the clamping ring 3 is provided in a plurality of models, at least one of which can be arranged relative to the rim 8 in a different way from that described.

Where the teat according to the invention 1 is concerned, this possesses, likewise in a conventional way, a flat annular collar 30 perpendicular relative to the axis 4 and ensuring that the teat 1 is fastened to the feeding bottle 2 as a result of retention between the rim 8 of the latter and the flange 11 of the ring 3, a bell-shaped tubular body 31, to which the collar 30 is connected towards the axis 4 and which passes through the flange 11 via a coaxial hole 32 in the latter, defined by its inner peripheral face 19, and a nipple 33 closing the tubular body 31 opposite its connection to the collar 30 and intended to be subjected to sucking motion by the child user; the collar 30, the tubular body 31 and the nipple 33 are produced in one piece from an elastically flexible and elastically compressible sealing material, for example a silicone rubber having a Shore hardness A of the order of 30 to 70, and are leakproof except for an orifice in the general form of a slit 34 arranged along the axis 4 in the nipple 3, for example according to an arrangement described in French Patent Application No. 88 02290 of 25th Feb. 1988, this example being in no way limiting; however, preferably, as with the slit-shaped orifice 34 described in this prior French Patent Application, the orifice 34 has in detail such a form that, by rotating the assembly formed by the feeding bottle 2, the ring 3 and the teat 1 about the common axis 4, the effective cross-section of this orifice 34 obtained during the sucking movements can be matched to the child's appetite with the aid of locating marks 135, for example provided at three points offset angularly at a 120° relative to one another about the axis 4 on the tubular body 31 and, for example, in the form of studs or figures in relief.

The respective forms of the tubular body 31 and of the nipple 33 and the form of the orifice 34 are not characteristics of the present invention and will not be described in any more detail; they could be different from those illustrated, and in particular the tubular body 31 and the nipple 33 could have a form different from a form rotational about the axis 4; it will be seen, however, that, at its connection to the collar 30 and in the vicinity of this connection, the tubular body 31 is delimited respectively towards the axis 4 and in the direction going away from this by respective inner and outer peripheral faces 35 and 36 cylindrically rotational about the axis 4 and respectively with a radius $R_7$ smaller than $R_5$ and a radius substantially equal to $R_5$, in such a way that the outer peripheral face 36 of the tubular body 31 is laid against the inner peripheral face 19 of the flange 11 at the passage through the hole 32 of the latter of the tubular body 31; immediately opposite the face 24 of the flange 11, the tubular body 31 carries integrally, by being produced in one piece with it, an annular prjection 37 rotational about the axis 4, stiffening the tubular body 31 locally and bearing on the face 24 of the flange 11 in a position opposite that of the collar 30 relative to this flange 11.

Figure 1:
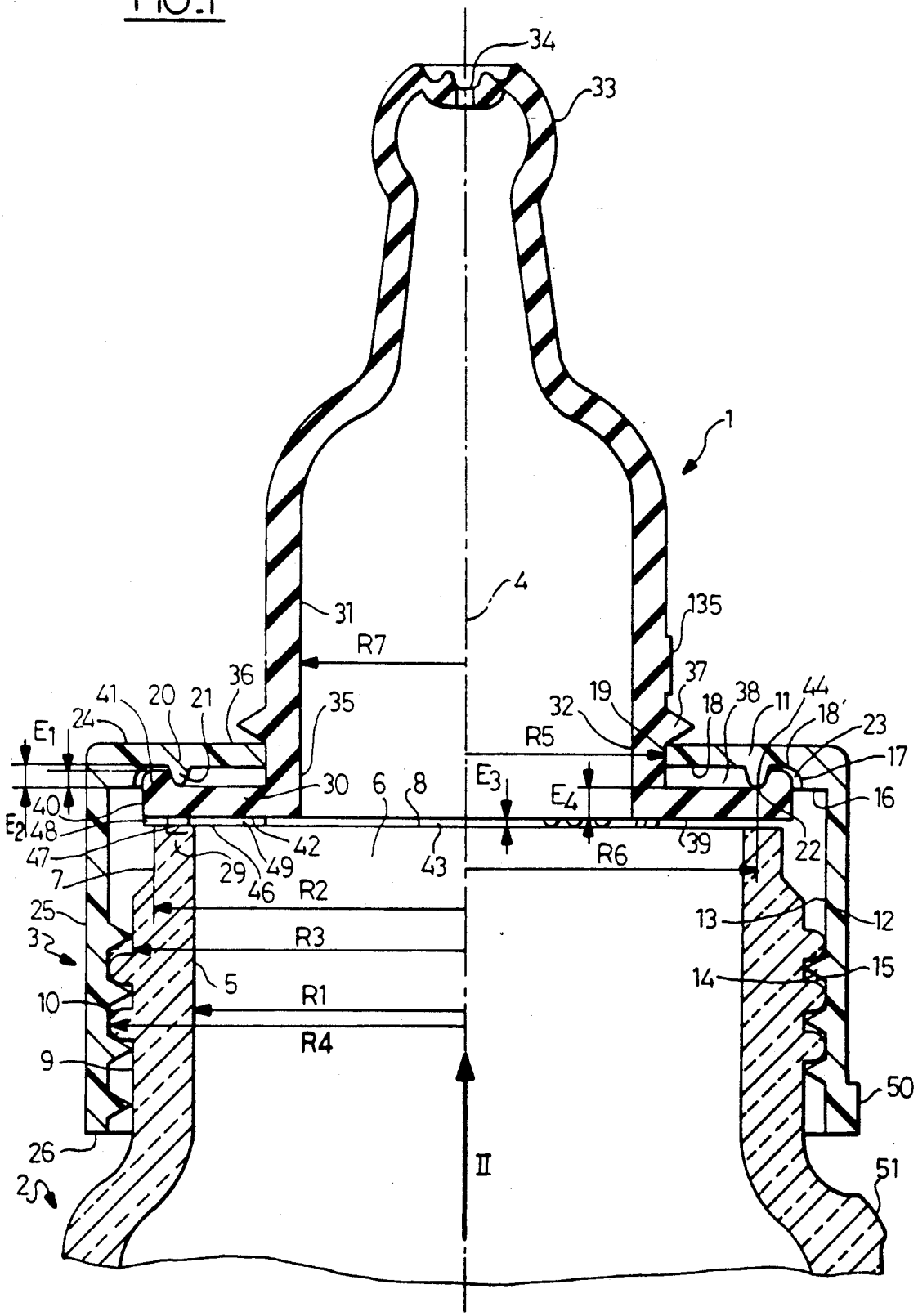
FIG. 1 shows the assembly of a feeding bottle, of a clamping ring and of a teat according to the invention, that is to say having the interrupted ribs characteristic of the invention, in a section taken in a plane passing through an axis relative to which the teat, the clamping ring and at least one neck zone of the feeding bottle have a rotational symmetry, this plane being designated by I—I in FIG. 2, and the air-inlet passages having their maximum effective cross-section.
Figure 2:
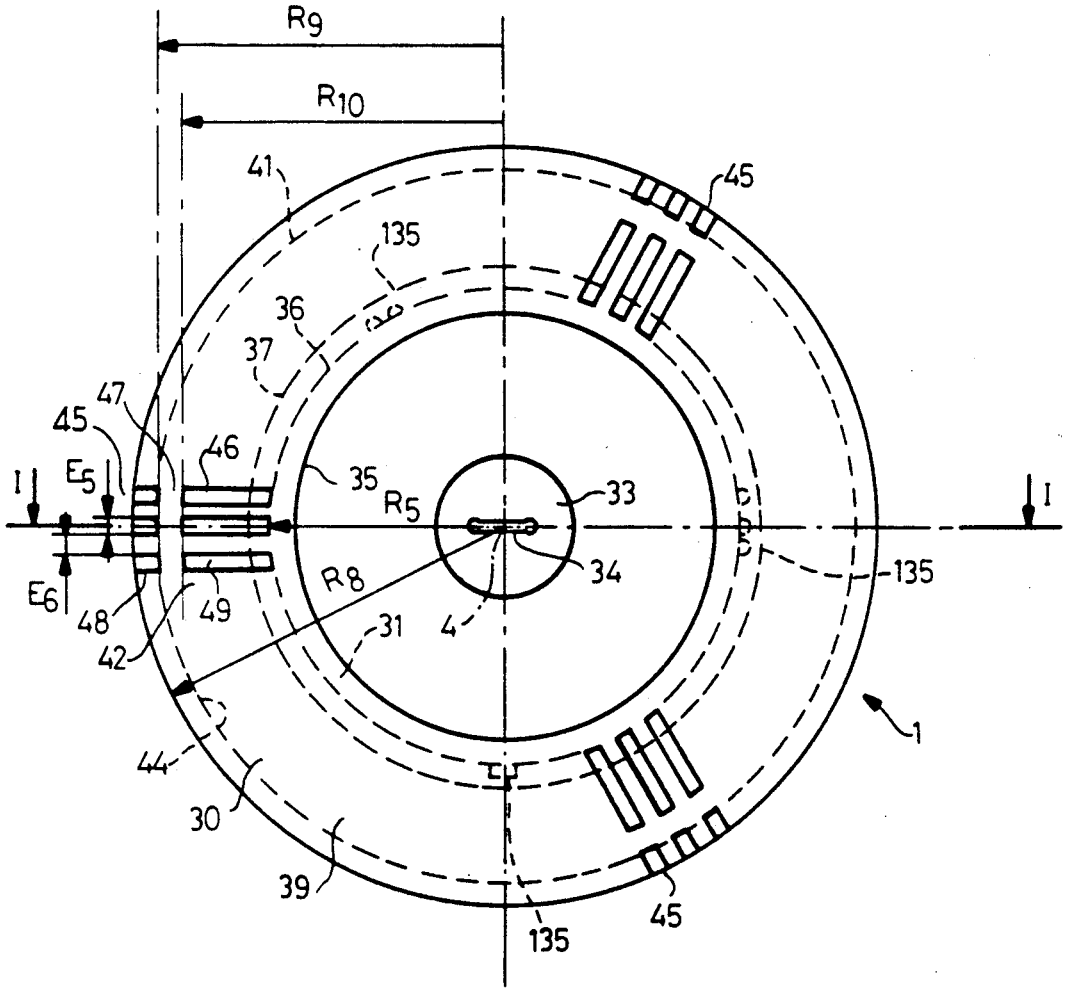
FIG. 2 shows an axial view of the teat in a direction designated by an arrow II in FIG. 1.

Between this flange 11 and the rim 8, the collar 30 possesses respectively towards the flange 11 and towards the rim 8 plane annular upper and lower faces 38 and 39, respectively, perpendicular relative to the axis 4 in the non-deformed state illustrated in FIGS. 1 to 3, and these faces are connected respectively to the outer peripheral face 36 of the tubular body 31 and to the inner peripheral face 35 of the latter in the direction coming nearer to the axis 4; in the direction going away from this axis 4, the face 39 confronting the rim 8 is connected to an outer peripheral cant 40 of the collar 30, the said cant facing in the direction going away from the axis 4 and having a form substantially cylindrically rotational about the latter, with a radius $R_8$ (FIG. 2) intermediate between the radii $R_2$ and $R_3$; the face 38 confronting the flange 11 is likewise connected to this outer peripheral cant 40 in the direction going away from the axis 4, but this connection is indirect and is made by means of an annular peripheral edge 41 projecting relative to this face 38 in parallel with the axis 4 over a thickness $E_1$ smaller than the distance $E_2$ which, in parallel with the axis 4, separates the face 16 of the flange 11 and the zone 22 of the annular moulding 21 of the latter opposite the face 18 of the flange 11, including the region of the zone 18' of the latter within the annular groove 23.

The connection of the face 38 of the collar 30 to the annular edge 41 is made in an annular zone 44 corresponding substantially to a circle of radius $R_6$, and the edge 41 has towards the axis 4 a form complementary to the form which the moulding 21 of the flange 11 assumes in the direction going away from the axis 4, towards the inside of the annular groove 23, with the result that the collar 30 and the flange 11 can occupy the position illustrated in FIGS. 1 to 3, in which the moulding 21 of the flange 11 bears flat with its zone 22 on the face 38 of the collar 30 in the zone 44 connecting this face 38 to the edge 41 which itself engages into the annular groove 23, but without coming in contact either with the zone 18' of the face 18 or with the face 17, whereas it mates with the moulding 21 inside the groove 23, thereby ensuring an exact coaxiality of the teat 1 in relation to the ring 3, that is to say likewise in relation to the neck zone 5 of the feeding bottle 2; it will be seen that, where the present invention is concerned, the annular edge 41 can be of any form whatever, with the proviso of the need for the annular edge 41 thus to mate at least locally with the moulding 21 within the groove 23, in order to ensure such coaxiality, and of the preferred aim of absence of contact between this edge 41 and the zone 18'' of the face 18 and with the face 17 delimiting the annular groove 23.

The face 39 of the collar 30 confronting the rim 8 itself possesses, projecting towards the latter in parallel with the axis 4, a plurality of substantially radial ribs 42, by means of which the face 39 bears on the rim 8 without coming in direct contact with the latter in the absence of any deformation of the collar 30, as illustrated in FIGS. 1 and 3, in such a way that, between the rim 8 and the face 39, air-inlet passages 43 remain between the ribs 42.

As a non-limiting example, three groups 45, offset angularly at 120° relative to one another about the axis 4, of three of these ribs 42 have been illustrated, on the understanding that other arrangements of these ribs could be adopted, without thereby departing from the scope of the invention, these ribs nevertheless preferably being distributed angularly about the axis 4 in such a way as to maintain air-inlet passages 43 between virtually the entire rim 8 and virtually the entire face 39 of the collar 30 in the absence of any deformation of the latter.

In a way not shown specifically, but easily understandable to an average person skilled in the art, each of the ribs 42, when it is seen in a section taken in a plane perpendicular relative to a respective midplane including the axis 4, has a rectangular or trapezoidal cross-section narrowing in the direction going away from the face 39 in parallel with the axis 4, in this direction each rib 42 being delimited by a respective plane face 46 parallel to the face 39 and of the same orientation, the faces 46 and 39 being spaced from one another in parallel with the axis 4 at a thickness $E_3$ which is small in relation to the distance $E_4$ separating the faces 38 and 39 from one another in parallel with this axis 4, and which is, for example, of the order of 2 tenths to 5 tenths of a mm for a value of $E_4$ of the order of 1.5 to 3 mm, these figures being given by way of non-limiting example.

Circumferentially, by reference to the axis 4, each of the ribs 42 has, in the region of its face 46, an extent $E_5$ of the order of a mm.

Finally, radially with reference to the axis 4, each of the ribs 46 extends from the outer peripheral cant 40 of the collar 30 of radius $R_8$ up to a distance of the order of $R_5$; more generally, with reference to the axis 4, each rib 46 has a maximum radius, here formed by $R_8$ and larger than $R_2$, and a minimum radius, here formed by $R_5$ and smaller than $R_1$.

In a way characteristic of the present invention, each of the otherwise continuous ribs 42 has an interruption 47 subdividing it into two portions 48, 49 respectively further from the axis 4 and nearer to this; towards the axis 4, the portion 48 is thus interrupted at a distance $R_9$ from this axis 4 intermediate between $R_2$ and $R_6$, whilst in the direction going away from the axis 4 each portion 49 is interrupted at a distance $R_{10}$ from the latter intermediate between $R_1$ and $R_6$, in such a way that the interruptions 47 of the various ribs 46 are thus located opposite that annular zone 29 of the rim 8 opposite which the moulding 21 of the flange 11 is likewise located, at least where the zone 22 of this moulding 21 is concerned, as shown in FIGS. 1 and 3.

Thus, each portion 48 of a rib 42 bears on the rim 8 only between the annular zone 29 and the outer peripheral face 7 of the neck zone 5 of the feeding bottle 2, whilst each portion 49 of a rib 42 bears on the rim 8 only between this annular zone 29 and the inner peripheral face 6 of the neck zone 5, particularly when the collar 30 is free of any deformation, as shown in FIGS. 1 and 3.

It will be seen that a strictly radial positioning of the ribs 42 in relation to the axis 4 is not obligatory; thus, in the illustrated example having three groups 45 of three straight ribs 42, only that rib 42 located in an intermediate position between the other two ribs 42 is oriented strictly radially with reference to the axis 4, the other two ribs of the same group themselves being arranged parallel to this intermediate rib at a distance $E_6$ from the latter which is of the order of 1 mm, this figure being given as a non-limiting example.

Under these conditions, in particular, the collar 30 can occupy in relation to the rim 8 the position which is illustrated in FIGS. 1 and 3 and which corresponds, as regards the air-inlet passages 43, to a maximum possible value of their effective passage cross-section; this position of the collar 30 is reached by screwing the ring 3 onto the feeding bottle 2 just sufficiently to obtain a bearing of the faces 46 of the ribs 42 on the rim 8 and a bearing of the zone 22 of the moulding 21 of the flange 11 on the zone 44 of the collar 30, without causing any deformation of the latter.

However, by screwing the ring 3 onto the feeding bottle 2 to a greater extent, a deformation of the collar 30 can also be caused by means of a lever effect between, on the one hand, its zone 44 on which the zone 22 of the moulding 21 of the flange 11 bears and, on the other hand, the respective bearings of the portions 48 and 49 of each rib 46, on either side of the respective corresponding interruption 47, on the rim 8 respectively on either side of the annular zone 29 of the latter; admittedly, this results in a partial compression of the bearing zones of the portions 48 and 49 of the ribs 42, as emerges from an examination of FIG. 4, whilst the distance $E_4$ separating the faces 38 and 39 of the collar 30 from one another varies only imperceptibly; however, because the collar 30 is, in contrast, free to move towards the rim 8 between the ribs 42 and between the portions 48 and 49 of each of these, this likewise results essentially in a deformation of the face 39 of the collar 30 which is accentuated at the interruptions 47 of each rib 42 by the zone 22 of the moulding 21 which acts by the agency of the component material of the collar 30 located between the faces 38 and 39 of the latter, until contact is made continuously between this face 39 and the annular zone 29 of the rim 8, according to a ring passing through the interruptions 47 of the various ribs 42, as shown in FIG. 4 corresponding to this state of maximum deformation of the collar 30; it will easily be appreciated that, under those circumstances, the effective cross-section of the air-inlet passages 43 is zero or, in other words, that the collar 30 is in completely sealing or virtually completely sealing contact with the rim 8 of the feeding bottle 2.

It will likewise easily be appreciated that, by screwing the ring 3 onto the feeding bottle 2 intermediately between the screwings corresponding respectively to the absence of deformation of the collar 30, according to FIGS. 1 and 3, and to the maximum deformation of this collar 30, according to FIG. 4, the air-inlet passages 43 can be given any effective cross-section intermediate between the maximum effective cross-section obtained in the absence of any deformation of the collar 30 and a zero effective cross-section obtained as a result of the maximum deformation of the latter, that is to say the air-inlet possibilities can be modulated according to particular needs, especially in addition to the above-mentioned adjustment obtained by rotating the assembly consisting of the feeding bottle 2, the ring 3 and the teat 1 about the axis 4.

The detection of the limiting positions of the clamping ring in relation to the feeding bottle, corresponding respectively to the maximum effective cross-section of the air-inlet passages 43 under the conditions described with reference to FIGS. 1 and 3 and to the complete closure of these air-inlet passages 43 under the conditions described with reference to FIG. 4, is easily obtained, during screwing and unscrewing, by the feeling of resistance opposed to this screwing and to this unscrewing: in fact, screwing and unscrewing do not encounter any appreciable resistance if there is no bearing of the collar 30, on the one hand, on the flange 11 by means of the moulding 21 of the latter and, on the other hand, on the rim 8 of the feeding bottle 2, whereas they encounter appreciable resistance from the moment when such a bearing occurs on either side, and screwing encounters marked resistance when the air-inlet passages 43 are completely closed, that is to say under the conditions described with reference to FIG. 4.

Preferably, however, means are provided in a mutually complementary manner on the clamping ring 3 and on the feeding bottle 2, in order to make it possible to mark their state of mutual screwing, for example by marking their relative angular position round the axis 4, bearing in mind that the change from one of the said limiting positions to the other generally requires only a fraction of a revolution, for example one third of a revolution, of the clamping ring in relation to the feeding bottle because of the value usually adopted for the pitch of the threads 14 and 10 of the clamping ring 3 and of the feeding bottle 2, as compared with $E_3$. These means can consist, for example, of at least one stud or at least one spot 50 in relief on the outer peripheral face 25 of the skirt 12 of the clamping ring 3, in the immediate vicinity of the end face 26 of the latter, and of at least one stud or at least one spot 51 in relief on the feeding bottle 2, at a point located in the immediate vicinity of its neck zone 5, but unobstructed by the clamping ring 3, even in the position of the latter corresponding to the complete closure of the air-inlet passages 43; these studs or spots could likewise be made recessed or be replaced by any other means making it possible visually to associate a relative position of the clamping ring 3 and of the feeding bottle 2 with the occurrence of a bearing of the collar 30 in the non-deformed state on the flange 11 and on the rim 8 of the feeding bottle 2, under the conditions described with reference to FIGS. 1 and 3, during the fitting of the teat 1 onto the feeding bottle 2, and then to refer to this relative position in order to ascertain the degree of closing of the air-inlet passages 43 when the clamping ring 3 is screwed onto the feeding bottle 2 to a greater extent.

It will be seen that, whatever the deformation thereby imparted to the collar 30, a bearing of the portions 47 of the ribs 42 on the rim 8 of the feeding bottle 2 is preserved, whilst these portions 47 are arranged in direct correspondence with the annular edge 41 of the collar 30, thereby permanently maintaining between this annular edge 41 and the moulding 21 of the flange 11 a mutual engagement suitable for ensuring a coaxiality of the teat 1, of the ring 3 and of the feeding bottle 2; depending on the state of deformation of the collar 30, the annular edge 41 penetrates more or less into the annular groove 23, at the same time coming to a greater or lesser extent nearer, within this, to the zone 18' of the face 18, in the region of each of the ribs 42 and in the vicinity of the latter, as emerges from an examination of FIG. 4.

Figure 5:
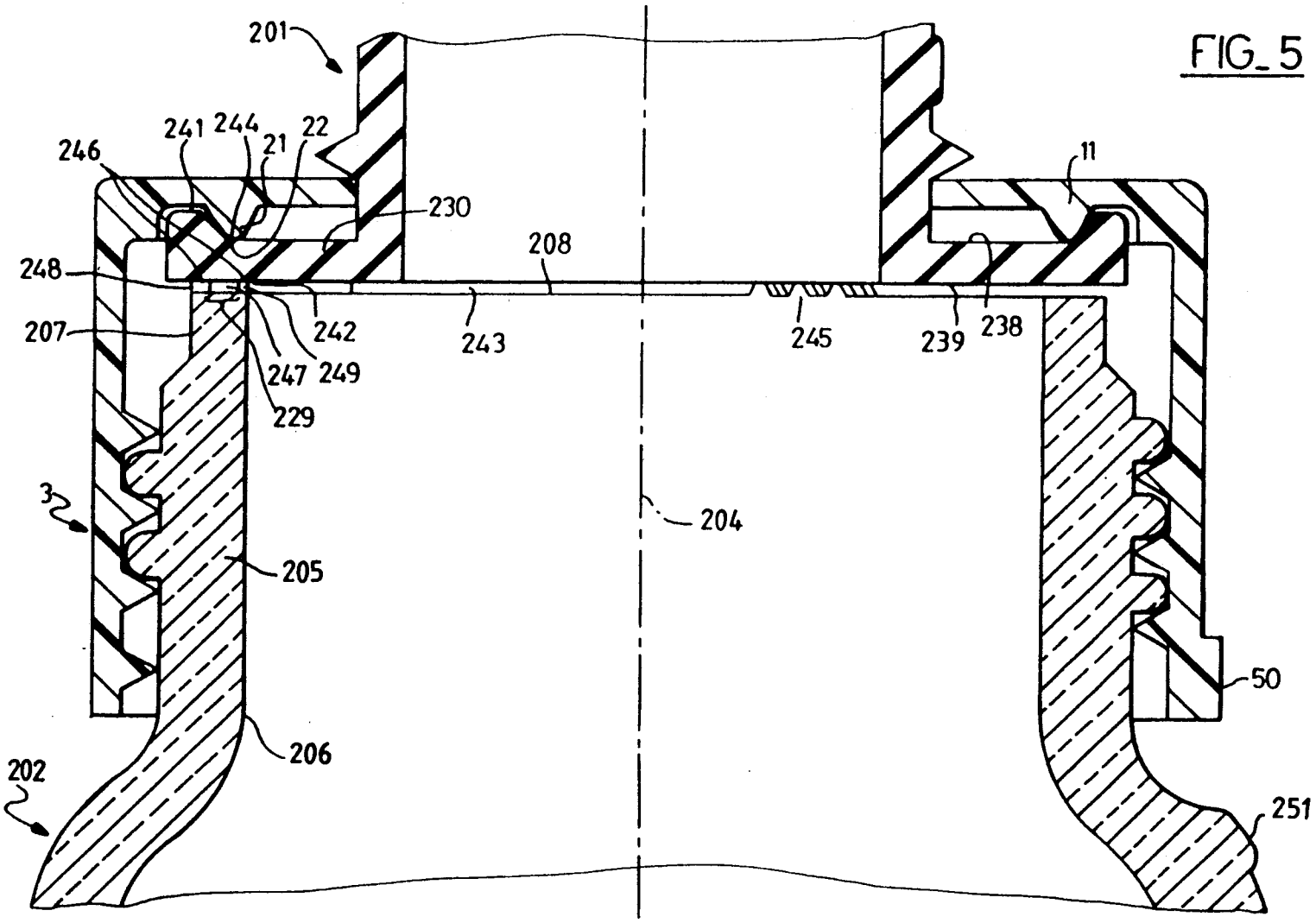
FIGS. 5 and 6 illustrate, in views corresponding respectively to that of FIG. 3 and to that of FIG. 4, the interaction of a feeding bottle according to the invention, that is to say having the interrupted ribs characteristic of the invention, with a teat and with a clamping rim.
Figure 6:
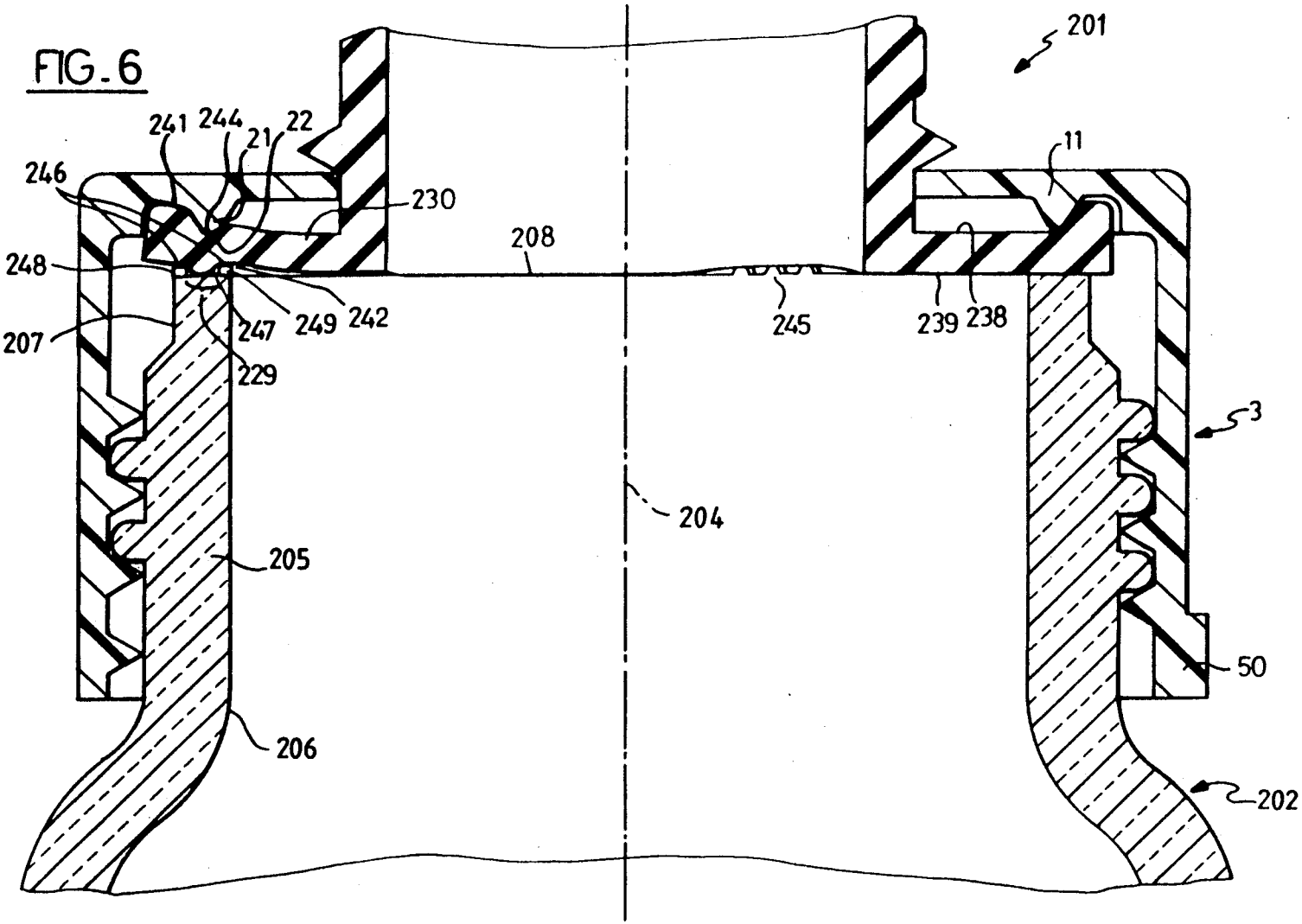

The possibilities and the advantages just described with reference to a teat according to the invention 1 having the ribs 47 interrupted in a way characteristic of the invention are afforded once again when these interrupted ribs are provided not on the teat, but on the annular face of the feeding bottle defining the rim of the latter, as shown in FIGS. 5 and 6 to which reference will now be made.

These figures show again in an identical way the above-described clamping ring 3, the various parts of which bear the same references as in FIGS. 1, 3 and 4, to the description of which reference will be made in this respect.

FIGS. 5 and 6 also show again a teat 201 and a feeding bottle 202 which, with the exception of the arrangement of the interrupted ribs characteristic of the invention on the feeding bottle and not on the teat, are identical to the teat 1 and to the feeding bottle 2 described with reference to FIGS. 1 to 4; thus, FIGS. 5 and 6 have the same references as in FIGS. 1 to 4, but increased by 200, to denote parts of the teat 201 and of the feeding bottle 202 respectively identical to parts of the teat 1 and of the feeding bottle 2, and reference will be made to the description of FIGS. 1 to 4 as regards these various parts.

In particular, the collar 230 of the teat 201 possesses, towards the annular rim face 208 of the feeding bottle 202, an annular face 239 which, when the collar 230 is at rest, as shown in FIG. 5, that is to say in the absence of any deformation of the collar 230, is plane and perpendicular to the axis 204. Contrary to the face 39 of the collar 30 of the teat 1, this face 239 is smooth, that is to say free of any relief similar to the ribs 42.

In contrast, instead of being smooth like the annular rim face 8 of the feeding bottle 2, the annular rim face 208 of the feeding bottle 202, although of a general annular form of revolution about the axis 204 and, for example, plane and perpendicular to the latter, possesses ribs 242 which are advantageously formed in one piece with the feeding bottle 201 and which extend substantially radially, with reference to the axis 204, from the inner peripheral face 206 of the neck 205 to its outer peripheral face 207 and are arranged, for example, as described with reference to the ribs 42, that is to say distributed in three groups 245 of three ribs 242 offset angularly relative to one another at 120° about the axis 204, on the understanding that other arrangements of ribs 242 could be adopted, without thereby departing from the scope of the present invention.

These ribs 242 have, for example, a rectangular or trapezoidal cross-section narrowing in the direction away from the rim 208 in parallel with the axis 204, when seen in a section taken in a plane perpendicular to a respective mid-plane including the axis 204, and are advantageously delimited in this direction by a respective plane face 246 parallel to the rim 208 and of the same orientation, the faces 246 and the rim 208 being spaced from one another in parallel with the axis 204 at the same thickness defined as the thickness $E_3$ and for example, of the order of 2 tenths to 5 tenths of a mm.

By means of these faces 246, the ribs 242 serve as a bearing point of the face 239 of the collar 230 of the teat 201 towards the rim 208 of the feeding bottle 202 and prevent the face 239 from coming in direct contact with the rim 208 in the absence of any deformation of the collar 230, so that between the rim 208 and the face 239 there thus remain air-inlet passages 243 between the ribs 242, the ribs 242 having circumferential dimensions as stated in respect to the ribs 42, so that these air-inlet passages 243 are circumferentially as extensive as possible.

In a way characteristic of the present invention, each rib 242 has a localised interruption 247 in the annular zone 229 of the rim 208, opposite which is located the moulding 21 of the flange 11 or at least of the zone 22 of this moulding 21, and is therefore subdivided into two portions, themselves continuous 248, 249, respectively further from the axis 204 and nearer to this; the portion 248 is interrupted towards the axis 204 at a distance from the latter defined as the distance $R_g$, whilst the portion 249 is interrupted in the direction away from the axis 204 at a distance from the latter defined as the distance $R_{10}$.

Under these conditions, in particular, the collar 230 can occupy relative to the rim 208 the position illustrated in FIG. 5, which corresponds for the air-inlet passages 243 to a maximum possible value of their effective passage cross-section; this position of the collar 230 is reached by screwing the ring 3 onto the feeding bottle 202 just sufficiently to establish a bearing of the face 239 of the collar 230 on the faces 246 of the ribs 242 and a bearing of the zone 22 of the moulding 21 of the flange 11 on the zone 244 of the collar 230, without causing any deformation of the latter.

However, by screwing the ring 3 further onto the feeding bottle 202, it is also possible to cause a deformation of the collar 230 as a result of a lever effect between, on the one hand, its zone 244 by which the zone 22 of the moulding 21 of the flange 11 bears and, on the other hand, its respective bearing points on the portions 248 and 249 of each rib 246 on either side of the respectively corresponding interruption 247, that is to say respectively on either side of the annular zone 229 of the rim 208; although this results in a partial and narrowly localised compression of the collar 230 between its faces 238 and 239 in line with the said bearing points, nevertheless, because the collar 230 is free to move towards the rim 208 between the ribs 242 and between the portions 248 and 249 of each of these, this likewise and essentially results in a deformation of the face 239 of the collar 230 as far as the interruptions 247 of each rib 242 by the zone 22 of the moulding 21 acting by means of the component material of the collar 230 located between the faces 238 and 239 of the latter, until contact is made between this face 239 and the annular zone 229 of the rim 208 continuously according to a ring passing through the interruptions 247 of various ribs 242, as shown in FIG. 6 corresponding to this state of maximum deformation of the collar 230; it will easily be appreciated that, then, the effective cross-section of the air-inlet passages 243 is zero or, in other words, that the collar 230 is in complete or virtually complete sealing contact with the rim 208 of the feeding bottle 202.

It will be also easily be appreciated that, by screwing the ring 3 onto the feeding bottle 202 intermediately between the screwings corresponding respectively to the absence of deformation of the collar 230, according to FIG. 5, and to the maximum deformation of this collar 230, according to FIG. 5, the air-inlet passages 243 can be given any effective cross-section intermediate between the maximum effective cross-section obtained in the absence of deformation of the collar 230 and a zero effective cross-section obtained as a result of the maximum deformation of the latter, that is to say the air-inlet possibilities can be regulated according to requirements, especially in addition to an adjustment similar to the adjustment mentioned above with reference to FIGS. 1 to 4, obtained as a result of the rotation of the assembly consisting of the feeding bottle 202, of the ring 3 and of the teat 201 about the axis 4.

The limiting positions of the clamping ring relative to the feeding bottle, corresponding respectively to the maximum effective cross-section of the air-inlet passages 243 and to the complete closure of these, can be identified by sensing a resistance opposed to the mutual screwing or unscrewing or by indicating the relative angular position of the clamping ring and of the feeding bottle by means similar to those described with reference to FIGS. 1 to 4, for example by means of at least one stud or at least one point 50 of the clamping ring 3 and at least one stud or at least one point 251 in relief on the feeding bottle.

Of course, like the teat 1 in the region of its collar 30, the teat 201 in the region of its collar 230 tends to resume elastically its rest configuration corresponding to a maximum opening of the air-inlet passages 43, 243, as soon as an unscrewing of the clamping ring 3 from the feeding bottle 2, 202 causes the stress towards the rim 8, 208 of the feeding bottle 2, 202 which is exerted on the collar 30, 230 by the moulding 21 of the flange 11 of the clamping ring 3 to cease.

Of course, the present invention can have many alternative embodiments in comparison with the non-limiting examples described, and in particular alternative versions can relate to the shaping and arrangement of the ribs 42, 242.

Figure 7:
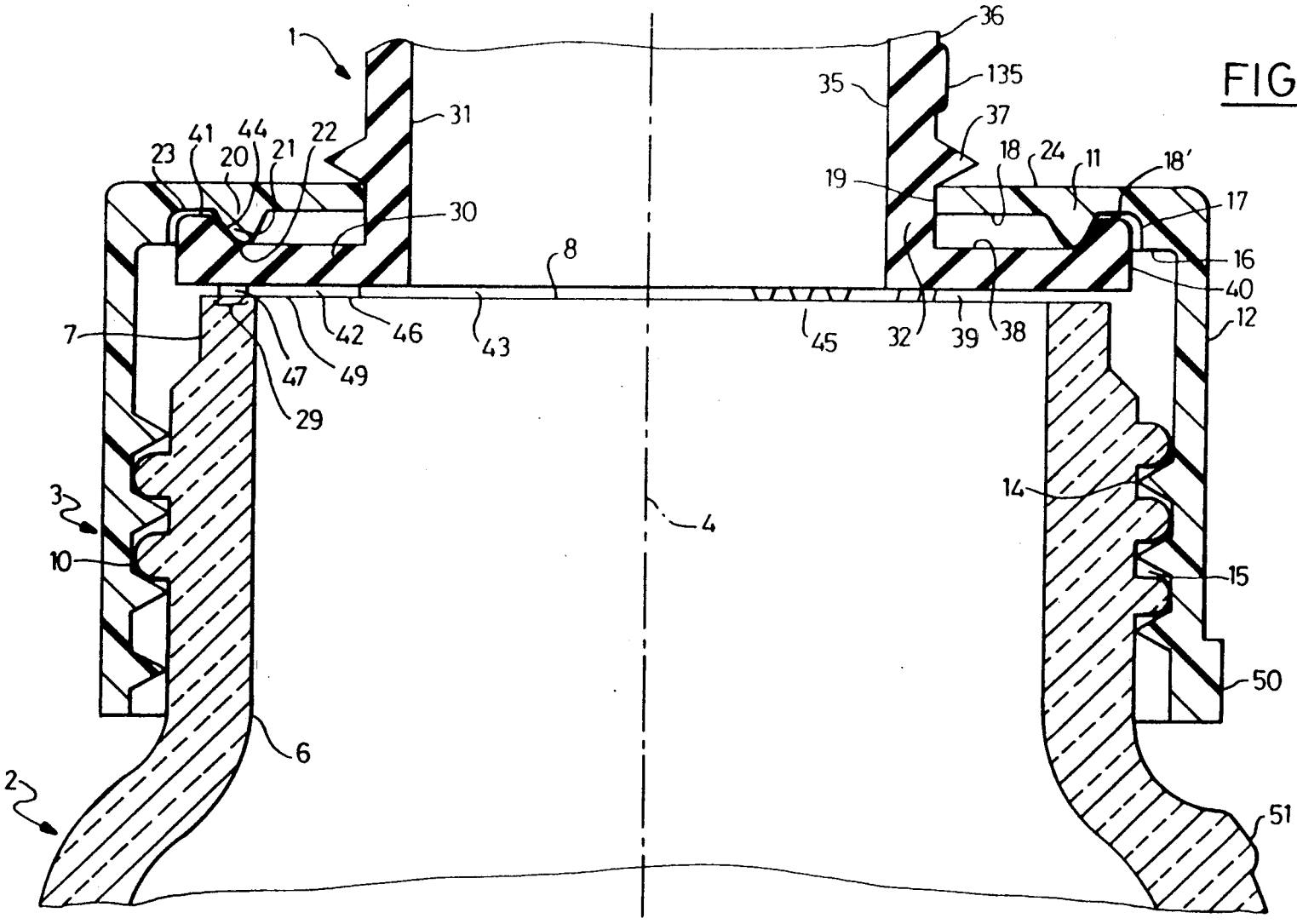
FIGS. 7 and 8 illustrate alternative embodiments to FIGS. 3 and 5, respectively, where a rib is located only on one side of the interruption.
Figure 8:
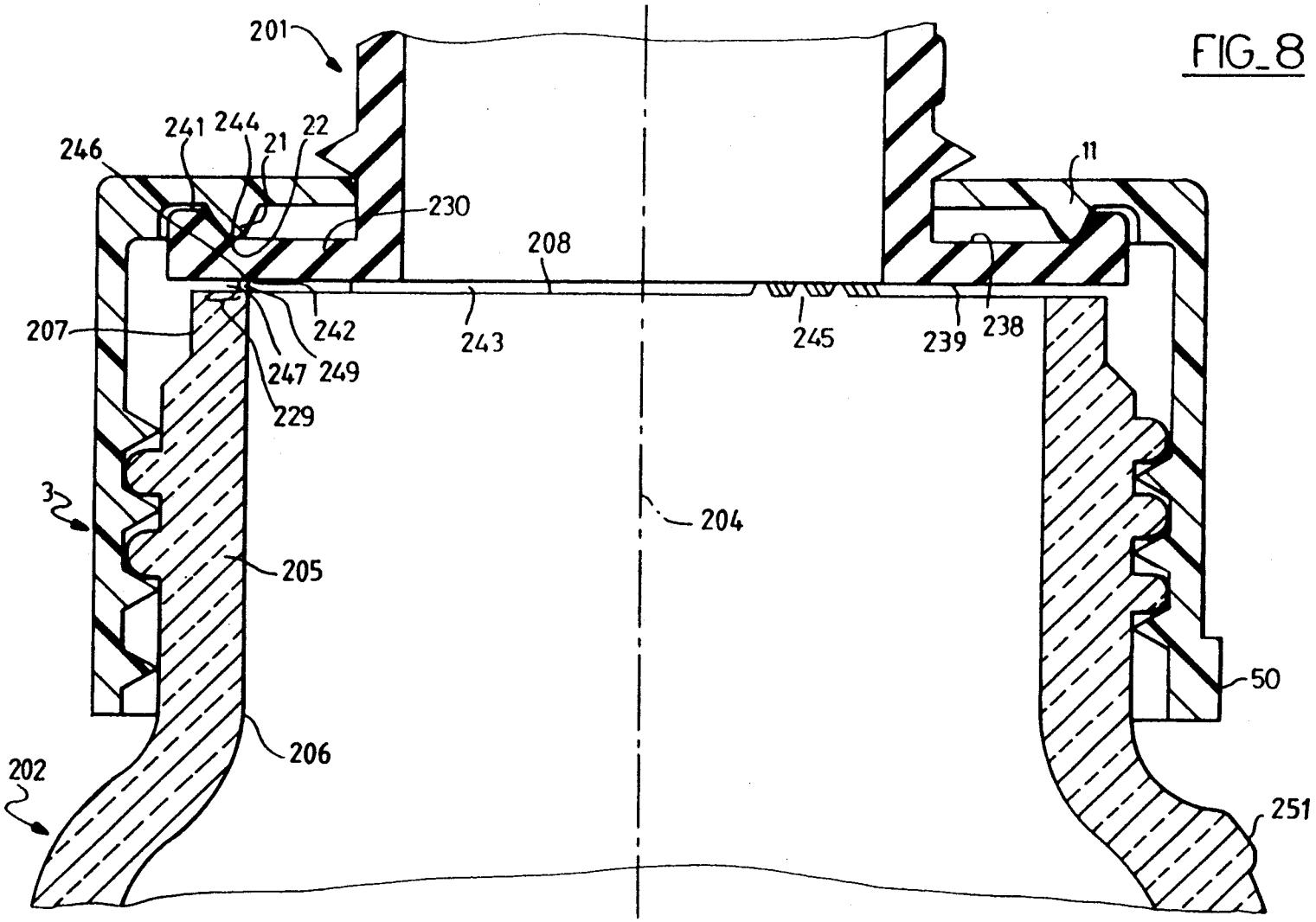

In particular, instead of being located respectively on either side of the annular zone 29, 229 of the rim 8, 208, FIGS. 7 and 8 show that these ribs could be located on only one side of this annular zone 29, 229. Like reference numerals between FIGS. 3 and 5 and FIGS. 7 and 8, respectively, identify the like parts. However, a bearing of the collar 30, 230 on the rim 8, 208 by means of the ribs, such as 42, 242, on either side of the annular zone 29, 229 is preferred because of the reliability which it affords as regards properly maintaining a specific effective cross-section of the air-inlet passages 43, 243; in the hypothesis of such a bearing of the ribs 42 or on the ribs 242 on only one side of the annular zone 29, 229, if the coaxiality of the teat 1, 201, the ring 3 and of the feeding bottle 2, 202 continued to be maintained by mutual engagement of an annular edge 41, 241 of the collar 30, 230 of the teat 1, 201 and of a moulding 21 of the flange 11 of the ring 3, and in comparison with the embodiments of the invention described, for this purpose the portion 48, 248 of each of the ribs 42, 242 described would preferably be preserved, that is to say the portion of these ribs which is arranged in correspondence with the annular edge 41, 241 and which ensures the permanent engagement of the latter with the moulding 21.

Moreover, these ribs 42, 242 could be replaced by any other relief provided on the face 39, 239 of the collar 30, 230 or on the rim 8, 208 of the feeding bottle 2, 202 and capable of making air-inlet passages 43, 243 between this face 39, 239 and the rim 8, 208 of the feeding bottle 2, 202 in the absence of any deformation of the collar, especially by bosses, inscriptions or various markings, these examples being in no way limiting.

Alternative versions can also relate to other parts of the collar 30, 230, of which, for example, the annular edge 41, 241 could be omitted in a simplified embodiment of the teat 1, 201 according to the invention, and to the shaping of the clamping ring 3 and of the neck zone 5, 205 of the feeding bottle 2, 202, of which, in particular, the rim face 8, 208 could be convex instead of being plane; in particular, in a simplified embodiment of the present invention, it would be possible to allow the absence of the moulding 21 of the flange 11, but this would have the disadvantage of giving rise to the need for a higher screwing force in order to obtain a complete closure of the air-inlet passages 43, 243.

I claim:

1. A feeding-bottle device, comprising:

a feeding bottle having an annular rim face and an externally threaded portion adjacent the annular rim face;

a clamping ring having a complimentary internally threaded portion screwed onto the feeding bottle and having an annular flange possessing, towards the annular rim face, an annular moulding located opposite a localized annular zone of the annular rim face and an annular groove formed around the moulding in the immediate vicinity of the latter;

a teat having a flat sealing elastically flexible and elastically compressible annular collar retained between the annular rim face and the flange, the collar possessing a first flat annular face located opposite the flange and coming to bear on the moulding of the latter and a second flat annular face located opposite the annular rim face, in which one of the two faces consisting respectively of the second face of the collar and of the annular rim face has a plurality of substantially radial ribs coming to bear on the other of the said two faces, at the same time between them delimiting air-inlet passages with one of the said two faces and the other, characterized in that each of the ribs has an interruption in a zone located opposite the said localized annular zone of the annular rim face, in such a way that it is possible, by screwing the clamping ring onto the feeding bottle to a greater or lesser extent, to adjust the effective cross-section of the air-inlet passages, deforming the collar elastically as a result of a lever effect exerted between the bearing point of its first face on the moulding of the flange and the bearing point of the ribs on the said other of the said two faces.

2. A device according to claim 1, characterized in that a rib is located only on one side of the respective interruption, in order to come to bear on the said other of the said two faces on only one side of this interruption.

3. A device according to claim 1, characterized in that a rib comprises two portions located respectively on either side of the respective interruption, in order to come to bear on the said other of the said two faces on either side of this interruption.

4. A device according to any of one of claims 1 to 3, characterized in that the first face of the collar possesses, around a localized annular zone corresponding to the interruptions of the ribs, an annular edge engaged in the groove of the flange.

5. A device according to claim 1, characterized in that the first face of the collar possesses, around a localized annular zone corresponding to the interruptions of the ribs, an annular edge engaged in the groove of the flange and further characterized in that a rib is located only on one side of the interruption in correspondence with the edge of the first face of the collar, in order to come to bear on the said other of the said two faces on only one side of the interruption.

6. A device according to claim 1, characterized in that the first face of the collar possesses, around a localized annular zone corresponding to the interruptions of the ribs, an annular edge engaged in the groove of the flange and further characterized in that a rib comprises two portions located respectively on either side of the respective interruption in correspondence with the edge of the first face of the collar, in order to come to bear on the said other of the said two faces on either side of the interruption.

7. A device according to claim 1, characterized in that it comprises three groups of at least one of the said ribs, offset angularly at 120° relative to one another.

8. A device according to claim 7, characterized in that each group comprises three ribs.

9. A device according to claim 1, characterized in that the feeding bottle and the clamping ring carry in a complimentary manner means for identifying their mutual screwing state.

* * * * *